US006545204B1

(12) United States Patent
Wadell

(10) Patent No.: US 6,545,204 B1
(45) Date of Patent: Apr. 8, 2003

(54) MUSICAL EFFECT BOX PEDAL ASSEMBLY

(76) Inventor: Paul Wadell, 746 112th St., Roberts, WI (US) 54023

( * ) Notice: Subject to any disclaimer, the term of this patent is extended or adjusted under 35 U.S.C. 154(b) by 0 days.

(21) Appl. No.: 10/025,878

(22) Filed: Dec. 26, 2001

(51) Int. Cl.[7] ..... G10D 13/02
(52) U.S. Cl. ..... 84/422.1; 84/746
(58) Field of Search ..... 84/422.1, 746, 84/721, 720, 475, 426, 427, 422.2, 422.3

(56) References Cited

U.S. PATENT DOCUMENTS

| | | | | |
|---|---|---|---|---|
| 4,134,325 A | | 1/1979 | Loftus | |
| 4,216,696 A | | 8/1980 | Alexis, Jr. | |
| 4,520,710 A | | 6/1985 | Elliott, Jr. | |
| 5,091,613 A | * | 2/1992 | Rohde et al. | 200/86.5 |
| 5,591,929 A | | 1/1997 | Wellman | |
| 5,789,688 A | | 8/1998 | Schiano | |
| 5,866,829 A | * | 2/1999 | Pecoraro | 84/177 |
| 5,990,401 A | | 11/1999 | Braun et al. | |
| 6,215,055 B1 | * | 4/2001 | Saravis | 84/422.1 |
| 6,225,543 B1 | | 5/2001 | Miguel | |
| 6,255,574 B1 | | 7/2001 | Sapienza | |
| 6,376,759 B1 | * | 4/2002 | Suzuki | 84/615 |
| 6,380,472 B1 | * | 4/2002 | Sugiyama et al. | 84/478 |

* cited by examiner

*Primary Examiner*—Kim Lockett
(74) *Attorney, Agent, or Firm*—Tipton L. Randall

(57) ABSTRACT

A musical effect box pedal assembly includes a first pedal means adapted for operating a first musical effect box switch and a second pedal means adapted for operating a second musical effect box switch. A third pedal means, operatively connected to the first and second pedal means, allows independent operation of the first and second pedal means operating the associated first and second musical effect box switches. The third pedal means also simultaneously operates the first and second pedal means, thereby providing simultaneous operation of the associated first and second musical effect box switches.

14 Claims, 3 Drawing Sheets

MUSICAL EFFECT BOX PEDAL ASSEMBLY

BACKGROUND OF THE INVENTION

1. Field of the Invention

The present invention relates to a device that actuates musical effect boxes, and more particularly, to such a device that selectively actuates either one or two musical effect boxes.

2. Background Information

The subject matter of this invention is directed primarily to a device for selectively actuating one or more musical effect boxes by a musician. Several effect boxes are connected in series between an electronic musical instrument and an amplifier, with each box producing a specific effect on the music when actuated. The effect may be an echo, a reverberation, or some other addition/change to the signal transmitted to the amplifier. Since the musician's hands are engaged in playing the musical instrument, the effect boxes are actuated by means of a rocker switch, a push button, a toggle switch, or a similar switch element that the musician turns "ON" or "OFF" by the musician pressing the switch/button, usually by means of the musician's foot.

When a single effect is turned "ON" or "OFF," it is fairly simple for the musician to actuate a single switch/button at the proper time to start or stop the effect in time with the music. At times it is desirable to simultaneously commence two such effects, or to simultaneously commence one effect and cease a second effect. However, actuating two switches/buttons simultaneously can be difficult, particularly if actuating the switches/buttons is accomplished in time with the music being performed.

Some examples of novel devices for simultaneously actuating musical instruments by means of a musician's feet are disclosed in the following patents.

Loftus, in U.S. Pat. No. 4,134,325, describes a drum and pedal beater assembly in which a pair of beaters is connected to a pair of side-by-side pedals, such that the performer can engage one pedal with his toe and the other pedal with his heel to independently operate the two beaters against a common drum skin.

In U.S. Pat. No. 4,216,696, Alexis, Jr. discloses a cymbal stand assembly having two pedals near the bottom of the stand, one pedal for striking the cymbal and the other pedal for a vibration damper of the cymbal. Each pedal operates independently of the other.

Elliott, Jr., in U.S. Pat. No. 4,520,710, describes a drum and cymbal pedals assembly, having adjacent pedals, one for a drum and one for a cymbal. The pedals are rather complex with numerous cables and pivots for operating the strikers for the drum and cymbals.

In U.S. Pat. No. 5,591,929, Wellman discloses a quad bass drum pedal assembly which provides for beating drums selectively with either foot. The assembly includes two pairs of pedals, with each connected to four mallets. Each mallet can be actuated by two separate pedals of the assembly.

Schiano in U.S. Pat. No. 5,789,688, discloses a drum set actuator for selectively playing two high hat cymbals and a bass drum of a drum set. The assembly includes two foot pedals, one pedal used to actuate a mallet to beat the bass drum and another pedal used to actuate one of three buttons, with one button for each cymbal and one for a mallet for the bass drum. The buttons cause the cymbals or drum to be struck through mechanical linkages.

Braun et al., in U.S. Pat. No. 5,990,401, describe a dual foot pedal assembly for percussion instruments. The assembly includes adjacent foot pedals each operating a striker for an instrument. The two pedals can be pressed independently or simultaneously. One pedal is also linked to a remote striker, having another foot pedal for use with the player's other foot.

In U.S. Pat. No. 6,225,543, Miguel discloses a device with a pedal for at least two percussion instruments. The device includes a frame with a hinged foot pedal, having a shaft at the toe end, and a clamp for the user's shoe to hold it to the pedal. The hinged pedal pivots slightly so the user can move the shaft between two separate mechanisms held in the frame, each for operating one of the percussion instruments. The device is best seen in FIG. 3 of the patent.

U.S. Pat. No. 6,255,574 by Sapienza describes a device for a bass drum that includes two foot pedals with a mallet attached to each pedal. The user steps on one foot pedal which has an overlapping portion over the second foot pedal to cause a two beat contact with the drum. The user can also just step on the second foot pedal for a single contact of the mallet with the drum.

Thus, there is an unmet need for a device that is capable of selectively actuating one or two musical effect boxes by a musician with the actuation performed in time with the music played.

SUMMARY OF THE INVENTION

The invention is a pedal assembly for selectively actuating musical effect devices, commonly termed "effect boxes." Several effect boxes are connected in series between an electronic musical instrument and an amplifier, with each box producing a specific effect on the music when actuated. The effect boxes are actuated by means of a rocker switch, a push button, a toggle switch, or a similar switch element that the user turns "ON" or "OFF" by pressing the switch/button, usually by means of the musician's foot.

When using two or more effect boxes in series, it is desirable to be able to actuate either one separately, or both together. The present invention provides this capability. The musical effect box pedal assembly includes a first pedal means adapted for operating a first musical effect box switch and a second pedal means adapted for operating a second musical effect box switch. A third pedal means, operatively connected to the first and second pedal means, allows independent operation of the first and second pedal means operating the associated first and second musical effect box switches. The third pedal means also simultaneously operates the first and second pedal means, thereby providing simultaneous operation of the associated first and second musical effect box switches.

More specifically, the pedal assembly includes first and second hinged pedal units, each with a platform underneath the pedal. An effect box is mounted on each platform beneath the pedal with the switch actuated by pressing the pedal. Each pedal has an open top channel at the end opposite the hinged end. A third pedal, located between the two hinged pedals, has a T-bar at one end, with the T-bar extending into each channel at the ends of the two hinged pedal units. Each hinged pedal unit can be pressed to independently actuate the corresponding effect box, with the T-bar slipping from the open top channel of the pressed pedal. The musician can actuate both effect boxes by pressing the center pedal which moves both hinged pedals via the attached T-bar held in each open top channel. Thus, the musician is able to switch both effect boxes with a single movement of one foot.

DESCRIPTION OF THE PREFERRED EMBODIMENTS

Nomenclature

10 Musical Effect Box Pedal Assembly
20 First Pedal Member
25 First Base Member
30 Hinge Member
35 Channel Portion of First Pedal Member
40 Second Pedal Member
45 Second Base Member
50 Hinge Member
55 Channel Portion of Second Pedal Member
60 Third Pedal Member
65 Linear Bar Member
70 End Caps of Bar Member
B Musical Effect Box
C Switch of Musical Effect Box
W Signal Conducting Wire Construction The device of the present invention is a musical effect box pedal assembly for switching on and off electronic effects imparted to a signal conducted from a musical instrument to an amplifier and speaker system. The musical effect box pedal assembly includes a first pedal means adapted for operating a first musical effect box switch, a second pedal means adapted for operating a second musical effect box switch, and a third pedal means, operatively connected to the first and second pedal means. The third pedal means is configured to allow independent operation of the first and second pedal means operating the associated first and second musical effect box switches. The third pedal means also functions to simultaneously operate the first and second pedal means, thereby simultaneously operating the associated first and second musical effect box switches.

Figure 1:
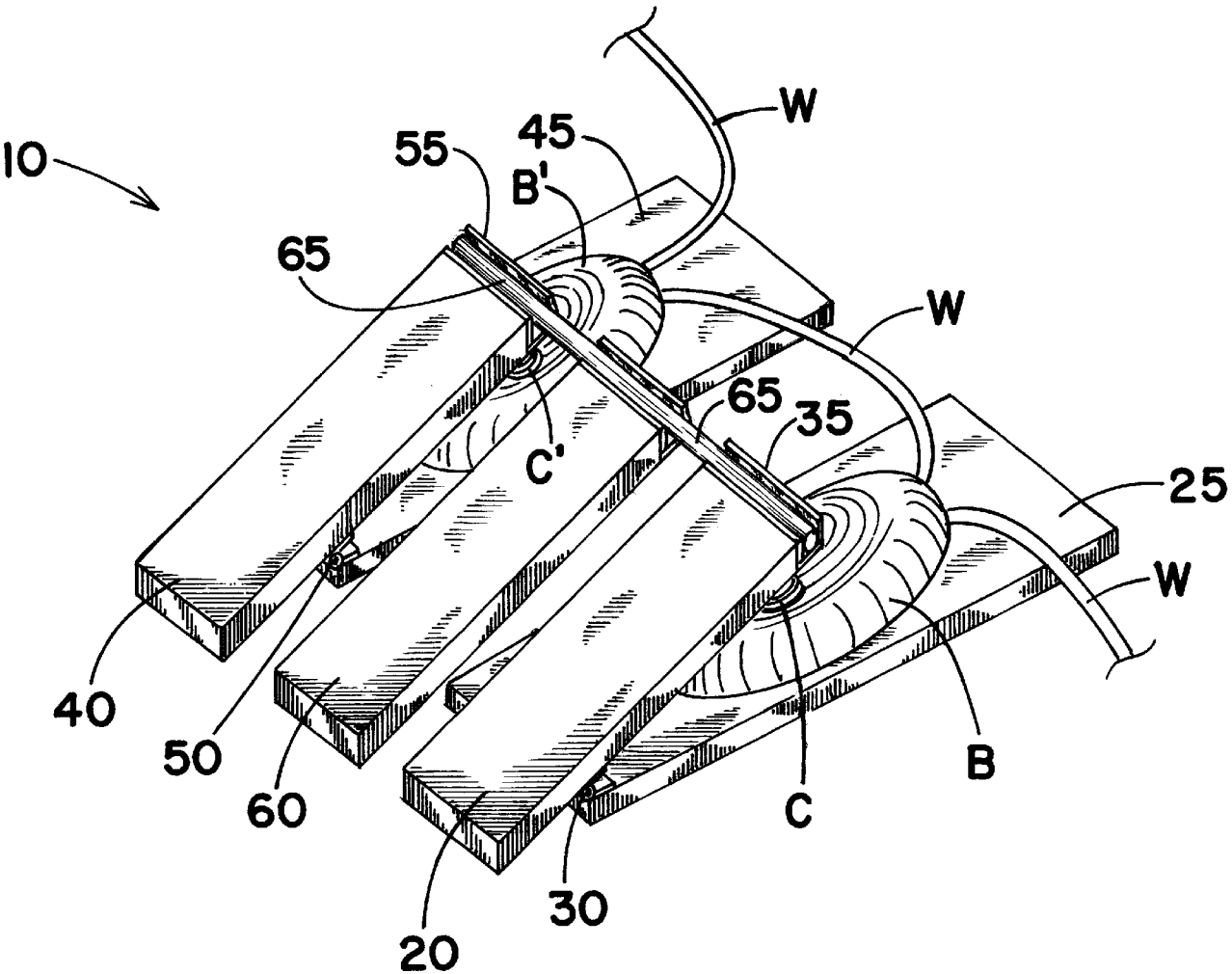
FIG. 1 is a perspective view of one embodiment of the present invention.
Figure 2:
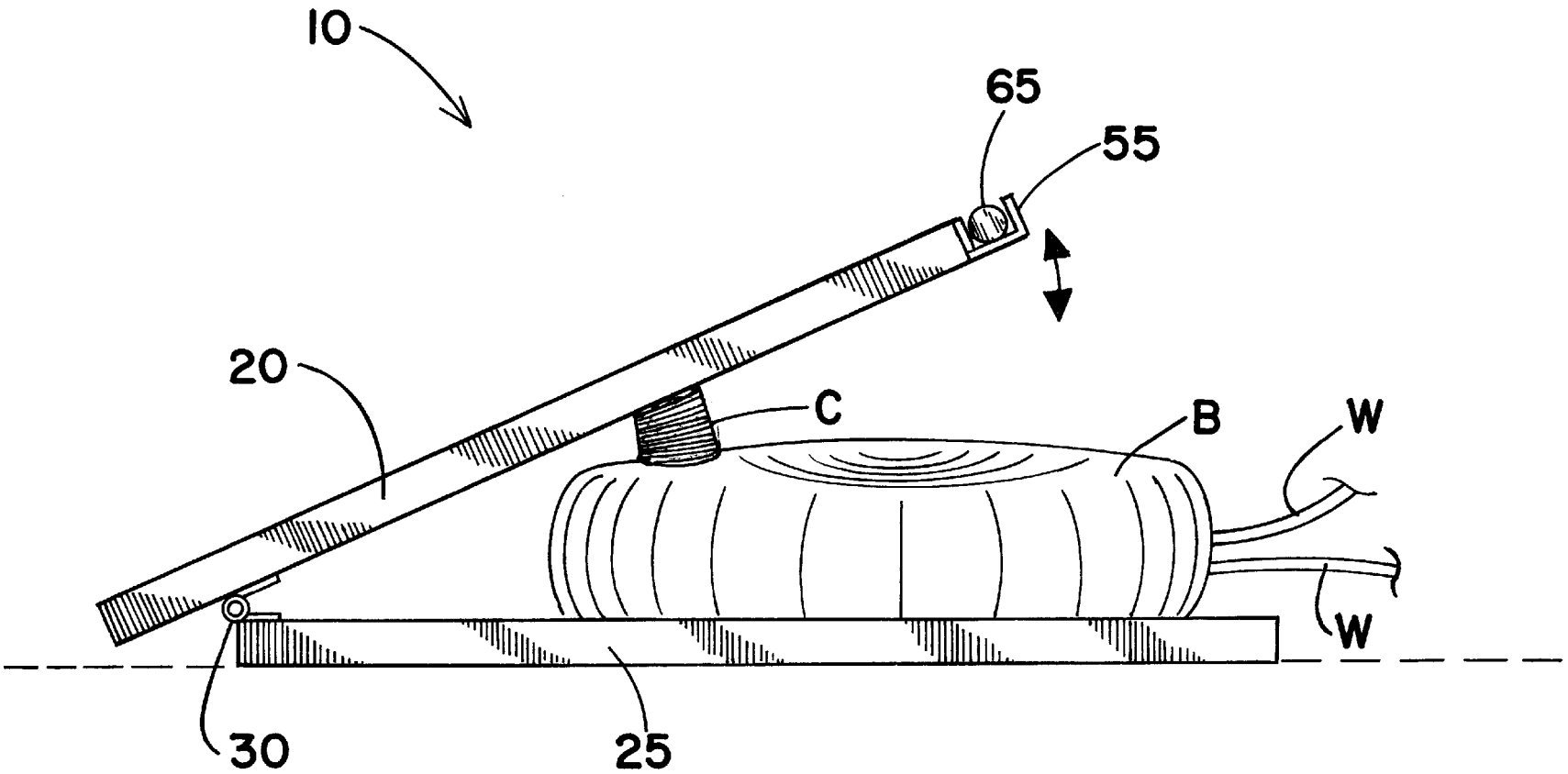
FIG. 2 is a side view of one embodiment of the present invention.
Figure 3:
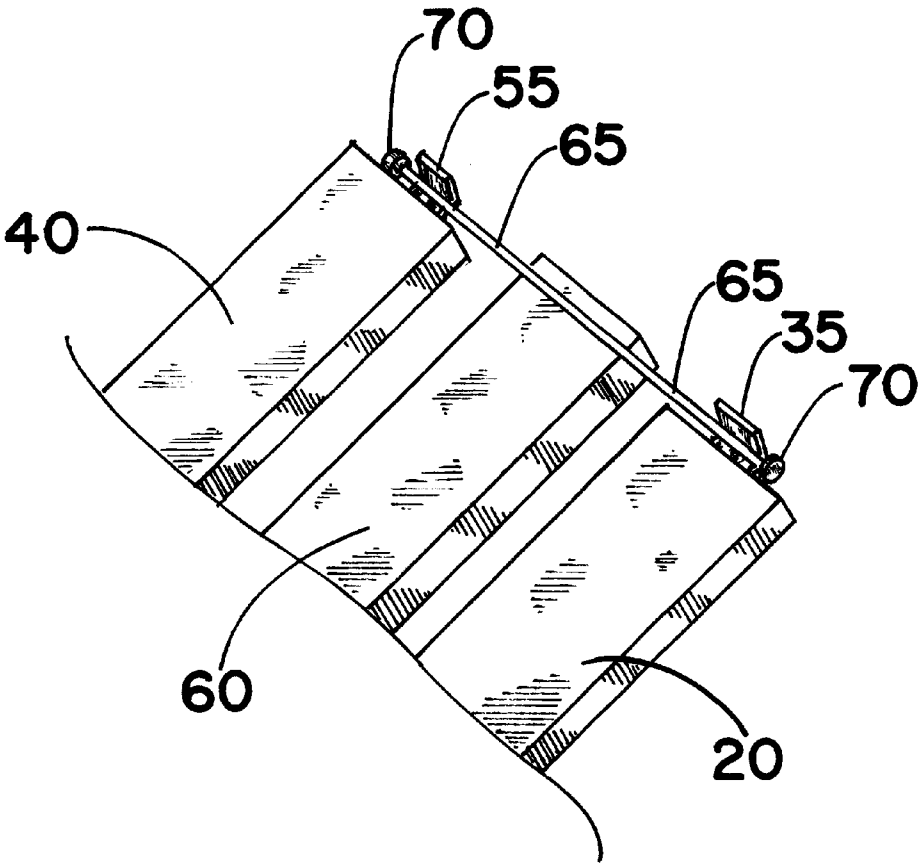
FIG. 3 is a perspective of a portion of a further embodiment of the present invention.

Referring now to FIGS. 1 and 2, the musical effect box pedal assembly 10 includes a first pedal member 20 hinged at one end to a first base member 25 and in register therewith, by means of a hinge member 30. The first base member 25 rests on a support surface, such as a floor. The first pedal member 20 has a bar-accepting open channel portion 35 at an end opposite the hinged end. The channel portion 35 is oriented with the opening opposite the first base member 25. The open channel portion 35 extends along the full width of the pedal member 20, as shown in FIG. 1. Alternatively, the open channel portion 35 extends along only a portion of the width of the pedal member 20, with the shorted open channel portion 35 centered on the pedal member 20, as shown in FIG. 3.

The first pedal member 20 and the first base member 25 are adapted for operating a first musical effect box switch C of a first musical effect box B positioned between the first pedal member 20 and the first base member 25. The musician operates the first pedal member 20 by pressing on it with one foot. The pressure on the first pedal member 20 causes the switch C of the box B to actuate, thereby either to turn on or to turn off the electronic effect provided by the musical effect box B.

The musical effect box pedal assembly 10 also includes a second pedal member 40 hinged at one end to a second base member 45 and in register therewith, by means of a hinge member 50. The second base member 45 rests on a support surface, such as a floor. The second pedal member 40 also has a bar-accepting open channel portion 55 at an end opposite the hinged end. The channel portion 55 is oriented with the opening opposite the second base member 45. The open channel portion 55 extends along the full width of the pedal member 40, as shown in FIG. 1. Alternatively, the open channel portion 55 extends along only a portion of the width of the pedal member 40, with the shorted open channel portion 55 centered on the pedal member 40, as shown in FIG. 3.

The second pedal member 40 and the second base member 45 are also adapted for operating a second musical effect box switch C' of a second musical effect box B', positioned between the second pedal member 40 and the second base member 45. The musician also operates the second pedal member 40 by pressing on it with one foot. The pressure on the second pedal member 40 causes the switch C' of the box B' to actuate to either turn on or turn off the electronic effect provided by the musical effect box B'.

The musical effect box pedal assembly 10 also includes a third pedal member 60, having a linear bar member 65 extending perpendicularly at one end of the pedal member 60. The third pedal member 60 is positioned between the first pedal member 20, hinged to the first base member 45, and the second pedal member 40, hinged to the second base member 45, with the linear bar member 65 moveably positioned in each of the bar-accepting open channel portions 35, 55 of the first pedal member 20 and second pedal member 40, respectively, as seen in FIG. 1. Although individual base members 25, 45 are shown associated with each pedal member 20, 40, both pedal members 20, 40 may be hinged to a single base member, if desired. The linear bar member 65 of the third pedal member 60 is of sufficient length to extend at least the full width of each bar-accepting open channel portion 35, 55 of the pedal members 20, 40. Additionally, with the ends of the bar member 65 extending beyond each open channel portion 35, 55, an end cap member 70 secured to each end of the bar member 65 serves to hold the three pedal member 20, 40, 60 of the pedal assembly 10 together, as shown in FIG. 3.

The upwardly oriented open channels 35, 65 of the first and second pedals 20, 40 allow either pedal member to move downwardly to actuate the associated switch C, C', without affecting the other pedal member. Thus, with the linear bar member 65 upwardly moveable within each open channel portion 35, 55 of the first pedal member 20 and the second pedal member 40, respectively, the third pedal member 60 with linear bar member 65 allows independent operation of the first and second pedal members 20, 40, operating the associated first and second musical effect box switches C, C', by the musician depressing either the first or second pedals. However, when the musician depresses the third pedal member 60, the linear bar member 65 in each open channel portion 35, 55 simultaneously operates the first and second pedal members 20, 40, thereby simultaneously operating the associated first and second musical effect box switches C, C'.

The musical effects provided by the boxes B, B', thus, can be switched on and off simultaneously by pressing the third pedal member 60. With one effect on and the other effect off, pressing the third pedal member 60 switches the musical signal from one effect to the other effect, simultaneously.

While the invention has been particularly shown and described with reference to preferred embodiments thereof, it will be understood by those skilled in the art that various changes in form and details may be made therein without departing from the spirit and scope of the invention.

I claim:

1. A musical effect box pedal assembly comprising;

(a) a first pedal means adapted for operating a first musical effect box switch, the first pedal means including a pedal member hinged at one end to a base member, the first pedal member having a bar-accepting channel portion at an end opposite the hinged end;

(b) a second pedal means adapted for operating a second musical effect box switch, the second pedal means including a pedal member hinged at one end to a base member, the second pedal member having a bar-accepting channel portion at an end opposite the hinged end; and (c) a third pedal means, operatively connected to said first and second pedal means, the third pedal means including a third pedal member having a linear bar member extending perpendicularly at one end thereof, the third pedal member positioned between said first pedal member hinged to said base member and said second pedal member hinged to said base member, with the linear bar member moveably positioned in each bar-accepting channel portion of said first and second pedal members, said third pedal means allowing independent operation of said first and second pedal means operating the associated first and second musical effect box switches, said third pedal means simultaneously operating said first and second pedal means, thereby simultaneously operating the associated first and second musical effect box switches.

2. The musical effect box pedal assembly according to claim 1, wherein the third pedal means is positioned between the first pedal means and the second pedal means and operatively connected thereto by a bar moveable in a channel of each first pedal means and second pedal means.

3. The musical effect box pedal assembly according to claim 1, wherein each pedal member channel portion has an opening opposite the base member.

4. A musical effect box pedal assembly comprising;

(a) a first pedal member hinged at one end to a base member, the first pedal member having a bar-accepting channel portion at an end opposite the hinged end, the first pedal member and base member adapted for operating a first musical effect box switch of a first musical effect box positioned between the first pedal member and the base member;

(b) a second pedal member hinged at one end to a base member, the second pedal member having a bar-accepting channel portion at an end opposite the hinged end, the second pedal member and base member adapted for operating a second musical effect box switch of a second musical effect box positioned between the second pedal member and the base member; and (c) a third pedal member having a linear bar member extending perpendicularly at one end thereof, the third pedal member positioned between said first pedal member hinged to said base member and said second pedal member hinged to said base member, with the linear bar member moveably positioned in each bar accepting channel portion of said first and second pedal members, whereby said third pedal member with linear bar member allows independent operation of said first and second pedal members operating the associated first and second musical effect box switches, said third pedal member with linear bar member simultaneously operating said first and second pedal members, thereby simultaneously operating the associated first and second musical effect box switches.

5. The musical effect box pedal assembly according to claim 4, wherein said first and second pedal members are hinged to a single base member.

6. The musical effect box pedal assembly according to claim 4, wherein said first and second pedal members are hinged to separate base members.

7. The musical effect box pedal assembly according to claim 4, wherein each pedal member channel portion has an opening opposite the base member.

8. The musical effect box pedal assembly according to claim 4, wherein said first and second pedal members each include a bar-accepting channel portion at one end thereof, said channel extending the full pedal width thereof.

9. The musical effect box pedal assembly according to claim 4, wherein said first and second pedal members each include a bar-accepting channel portion at one end thereof, said channel extending a portion of the pedal width thereof.

10. The musical effect box pedal assembly according to claim 4 further including an end cap member secured to each end of said linear bar member for holding together the three pedal members of the pedal assembly.

11. A musical effect box pedal assembly comprising;

(a) a first pedal member hinged at one end to a first base member, the first pedal member having a bar-accepting channel portion opposite said first base member at an end opposite the hinged end, the first pedal member and base member adapted for operating a first musical effect box switch of a first musical effect box positioned between the first pedal member and the base member;

(b) a second pedal member hinged at one end to a second base member, the second pedal member having a bar-accepting channel portion opposite said second base member at an end opposite the hinged end, the second pedal member and base member adapted for operating a second musical effect box switch of a second musical effect box positioned between the second pedal member and the base member; and (c) a third pedal member having a linear bar member extending perpendicularly at one end thereof, the third pedal member positioned between said first pedal member hinged to said base member and said second pedal member hinged to said base member, with the linear bar member moveably positioned in each bar accepting channel portion of said first and second pedal members, whereby said third pedal member with linear bar member allows independent operation of said first and second pedal members operating the associated first and second musical effect box switches, said third pedal member with linear bar member simultaneously operating said first and second pedal members, thereby simultaneously operating the associated first and second musical effect box switches.

12. The musical effect box pedal assembly according to claim 11, wherein each pedal member channel portion has an opening opposite the base member.

13. The musical effect box pedal assembly according to claim 11, wherein said first and second pedal members each include a bar-accepting channel portion at one end thereof, said channel extending the full pedal width thereof.

14. The musical effect box pedal assembly according to claim 11, wherein said first and second pedal members each include a bar-accepting channel portion at one end thereof, said channel extending a portion of the pedal width thereof.

* * * * *